US005618370A

United States Patent [19]

Popat et al.

[11] Patent Number: 5,618,370

[45] Date of Patent: Apr. 8, 1997

[54] COLOR APPLICATOR FOR LASER PRINTERS AND PHOTOCOPIERS

[75] Inventors: Ghanshyam H. Popat, Alta Loma, Calif.; Michael E. Hannington, Dyer, Ind.

[73] Assignee: Avery Dennison Corporation, Pasadena, Calif.

[21] Appl. No.: 410,226

[22] Filed: Mar. 24, 1995

Related U.S. Application Data

[63] Continuation-in-part of Ser. No. 249,021, May 25, 1994, abandoned.

[51] Int. Cl.[6] ..... B44C 1/16

[52] U.S. Cl. ..... 156/234; 156/238; 156/240; 156/241; 156/577

[58] Field of Search ..... 156/240, 234, 156/238, 230, 235, 577, 241

[56] References Cited

U.S. PATENT DOCUMENTS

| | | | |
|---|---|---|---|
| 4,028,292 | 6/1977 | Korpman . | |
| 4,157,412 | 6/1979 | Deneau | 156/235 X |
| 4,317,852 | 3/1982 | Ogden | 156/240 X |
| 4,717,621 | 1/1988 | So et al. . | |
| 4,851,278 | 7/1989 | Enanoza . | |
| 5,198,060 | 3/1993 | Kurtin | 156/240 X |
| 5,275,871 | 1/1994 | Hambright | 156/240 X |

FOREIGN PATENT DOCUMENTS

| | | | |
|---|---|---|---|
| 3296982 | 12/1988 | Japan | 156/240 |

*Primary Examiner*—David A. Simmons
*Assistant Examiner*—Paul M. Rivard
*Attorney, Agent, or Firm*—Poms, Smith, Lande & Rose Professional Corporation

[57] ABSTRACT

An applicator for, and a method of, selectively applying a color layer to a toner image formed on a substrate. The applicator is adapted to be removably secured to the substrate without the aid of additional implements such as adhesive tabs. After heat has been applied to the applicator, it will leave a color layer on the toner image, but not on the substrate.

34 Claims, 4 Drawing Sheets

COLOR APPLICATOR FOR LASER PRINTERS AND PHOTOCOPIERS

CROSS REFERENCE TO RELATED APPLICATION

This application is a continuation-in-part of U.S. patent application Ser. No. 08/249,021, filed May 25, 1994, now abandoned.

BACKGROUND OF THE INVENTION

1. Field of Invention

The present invention relates generally to the application of a colored layer to a toner image formed on a substrate and, more particularly, to an applicator for selectively applying a colored layer to a toner image.

2. Description of the Related Art

In recent years, the formation of toner images on paper and other substrates has become commonplace. Laser printers and photographic reproduction machines are common examples of devices that may be used to form toner images on a substrate. In such devices, the toner image is formed by applying toner powder to an electrostatic latent image formed on the substrate. The toner image is then fixed to the substrate by a developer which applies heat to the substrate, thereby melting the toner powder onto the substrate.

Unfortunately, common inexpensive laser printers and photographic reproduction machines are only equipped to apply black toner to the substrate. As such, those who wish to print in colors other than black must resort to the use of expensive color copiers and laser printers.

One proposed solution to this problem in the art is described in U.S. Pat. No. 4,724,026 to Nelson. The '026 patent is directed to a process for selective transfer of metallic foils to xerographic images. Referring to FIGS. 2 and 3 of the '026 patent, Nelson discloses a transfer sheet assembly consisting of a backing sheet and a transfer sheet which are secured to one another along one of the longitudinal ends of the assembly. The transfer sheet is composed of a number of layers—a carrier layer, a polymer film layer, a metallic film layer and a heat-activated adhesive layer. A substrate having a toner image formed thereon may be placed between the backing sheet and the transfer sheet with the toner image facing the heat-activated adhesive layer of the transfer sheet. Heat and pressure are then applied to all three, which causes the adhesive to bond to the toner image. The transfer sheet is then pulled away from the substrate and, as illustrated in FIG. 3 of the '026 patent, the heat activated adhesive bonds portions of the metallic film layer to the toner image.

There are a number of disadvantages associated with the process disclosed in the '026 patent. For example, an entire transfer sheet is consumed during each transfer process, thereby resulting in waste in those situations where only a small portion of the substrate includes a toner image. Also, it is impossible to position the transfer sheet so that only selected areas on the substrate are effected. Moreover, because the adhesive does not soften until heat is applied, the substrate may move relative to the transfer sheet prior to the bonding process.

Other disadvantages are related to the construction of the '026 transfer sheet. The sheet includes a number of layers of different materials (e.g., polymer film, metallic film and heat-activated adhesive layers) formed on a carrier. With the production methods described in the '026 patent, each of these layers are necessary in order to produce an opaque covering on the toner. There are, however, manufacturing costs associated with each step in any manufacturing process. As such, it would be desirable to produce an opaque toner covering which does not require as many layers of different materials.

Another specific implementation of the prior art method of applying color to a toner image formed on a substrate is illustrated in FIGS. 1 and 2 of the present application. Here, a color coating layer is formed on a strip of polyester film 10 which is stored in roll form. The strip 10 may be selectively positioned over a toner image formed on a substrate 12 through the use of adhesive tabs, or dots, 14. The application of heat and pressure to the toner image and strip 10, preferably by the fuser (or developing unit) of a laser printer or photocopier, causes the toner to soften. The softened toner binds to those portions of the color coating layer in contact with the toner. After the strip is removed, the color coating will remain on the toner image.

This method is essentially the same as that disclosed in the patent cited above with separate pressure sensitive adhesive dots being applied in a manner similar to the pressure sensitive adhesive strip used in the '026 patent. Similarly, there are a number of disadvantages associated with the prior art method illustrated in FIGS. 1 and 2. For example, the adhesive tabs, which must be individually peeled from a pad, tend to stick to the user's fingers. Also, arranging an adhesive tab on each corner of the strip is inconvenient and the tabs often come off inside the printer. Another disadvantage relates to the fact that paper (and other substrates) is not always perfectly flat when it is pulled into a laser printer from a feeding tray. Some portions may bow slightly. Because the prior art strip is only secured at the corners, the strip may bow away from the portion of the sheet which it covers. This may cause the printer to jam or cause the strip to be fully or partially peeled away from the substrate as it enters the printer. Finally, the sheet of unused adhesive tabs may become separated from the roll and lost or may be misplaced.

Finally, the prior art methods of applying color to a toner image fail to provide additional uses for the transfer sheet after some of its color has been applied to the toner.

SUMMARY OF THE INVENTION

The general object of the present invention is to provide an improved applicator for applying color to a toner image which obviates, for practical purposes, the aforementioned problems in the art. More particularly, one object of the present invention is to provide an applicator for applying color to a toner image which may be secured to a particular portion of a substrate so that the color may be selectively applied. Another object of the present invention is to provide an applicator for applying color to a toner image which does not require additional, separate apparatus to secure it to a substrate. Still another object of the present invention is to provide an applicator for applying color to a toner image which may be affixed to another substrate in label-like fashion after the color application process has been completed.

In order to accomplish these and other objectives, an applicator is provided which includes a backing member, a color coating, and a pressure sensitive adhesive which is active at room temperature ("room temperature" being defined as a temperature substantially between approximately 35° F. and 120° F.) to secure the applicator to a toner image. Preferably, the pressure sensitive adhesive is combined with the color coating, or overlies the color coating, with the color coating bonding to the toner image when heat and pressure are applied.

One preferred embodiment includes a color coating formed on a backing member. The color coating includes a pressure and heat sensitive adhesive which will removably adhere to a substrate and to a toner image upon application to the substrate at room temperature. When heat is applied, the color coating will bond to the toner image, but not to the substrate, to form a color layer on the toner image only. The backing member may be composed of an opaque material, a transparent material or a substantially translucent colored material.

In another preferred embodiment, a color coating strip is formed on a first portion of the front surface of a backing member and an adhesive coating strip is formed on a second portion of the front surface of the backing member. The color coating strip transfers color to toner images, but not to the substrate. The adhesive coating strip removably secures the applicator to the substrate at room temperature so that the color coating may be applied to the desired toner image.

In still another preferred embodiment, a color coating layer is formed on a backing member. A pressure and heat sensitive adhesive coating, which will removably adhere to the substrate at room temperature, is formed on the color coating layer. The adhesive will bond to toner, but not to the underlying substrate in response to heat and pressure. After the adhesive bonds to the toner, the backing can be pulled away from the substrate, leaving color on the toner image, but not the substrate. The backing member may be composed of an opaque material, a transparent material or a substantially translucent colored material.

The pressure and heat sensitive adhesive may advantageously be of a type that will remain somewhat tacky after the color application process has been completed. Such adhesives may also be of a type which, over time, will become permanent.

In a further preferred embodiment, a permanent color layer, which may be either opaque or substantially translucent, is formed on a backing member, with itself may be opaque, transparent or a substantially translucent color. A color coating layer, preferably composed of a color which contrasts with the color of the permanent layer, is formed on the permanent color layer. A pressure and heat sensitive adhesive, which will remain tacky (or even become permanent) after the transfer process, may be combined with the color coating. As described above, the adhesive will removably adhere to a substrate and a toner image at room temperature. After heat is applied, the color coating will bond to the toner image, but not to the substrate, to form a color layer on the toner image.

A portion of the permanent color layer, one which corresponds to the toner image, will no longer be covered by the color coating layer. If the permanent color layer is opaque, then the image will appear in the permanent layer's color against a background having the coating layer's color when viewed from the coating layer side of the applicator. Conversely, if the permanent color layer is substantially translucent, then the image will appear in the permanent layer's color against a background having the color that results from the combination of the coating layer and permanent layer's colors, when viewed through a transparent backing member. In each case, the applicator may then be affixed to-another substrate in order to place the image thereon in label-like fashion.

In a still further preferred embodiment, a permanent color layer, which may be either opaque or substantially translucent, is formed on a backing member, which itself may be opaque, transparent or colored and substantially translucent. A color coating layer, preferably composed of a color which contrasts with the color of the permanent layer, is formed on the permanent color layer. A substantially clear pressure and heat sensitive adhesive, which will remain tacky (or even become permanent) after the transfer process, is formed in a separate layer on the color coating layer. Again, the adhesive will removably adhere to a substrate and a toner image at room temperature. After heat is applied, the adhesive will bond to the toner image, but not to the substrate, to secure a portion of the color coating layer to the toner image.

As noted above, the image will appear in the permanent layer's color against a differently colored background. The color of the background depends on whether or not the permanent layer is opaque or substantially translucent and from which side the applicator is being viewed. The applicator may then be affixed to another substrate on which the user desires to display the image.

The preferred embodiments described above provide a number of advantages over the prior art. For example, the applicator may be selectively applied to one of many toner images on the substrate. A small portion of a printed document, such as the letterhead, may be colored while the rest remains black and white. As such, documents which appear to have been produced with more expensive equipment may be generated with a common laser printer or photocopier.

Additionally, because the present invention sticks directly to the substrate, without the need for additional implements like adhesive dots, it is far more convenient than the prior art. Also, the present invention is not merely attached at the corners, as is the prior art strip. Therefore, the present invention will not become separated from the substrate or damaged if the portion of the substrate to which it is applied bows as it enters the printer.

In those embodiments where the adhesive is of a type which will either remain tacky or eventually become permanent, the applicator may be used to form a version of the toner image on another substrate. For example, once an applicator having a color coating layer formed on a transparent backing has been used to apply a color coating to an address on a letter, the color coating will be removed from the applicator in the image of the address. When applicator is affixed to a white envelope, the white color will show through the color coating layer where toner has been removed. As such, the applicator will appear to be a colored label having an address printed in white thereon. As noted above, embodiments having a permanent color layer and a contrasting color coating layer may also be placed on another substrate after a color transfer process.

It is to be understood that application of the advantageous feature described above is not limited to use with letters and envelopes. Rather, it may be used in any situation where an image must appear in two places. For example, this advantageous feature may be applied to tabs which are marked with a word or number that appears in a document.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiment of the invention will be made with reference to the accompanying drawings.

DETAILED DESCRIPTION OF THE PREFERRED EMBODIMENTS

The following is a detailed description of the best presently known modes of carrying out the invention. This description is not to be taken in a limiting sense, but is made merely for the purpose of illustrating the general principles of the invention. The scope of the invention is defined by the appended claims.

Figure 3:
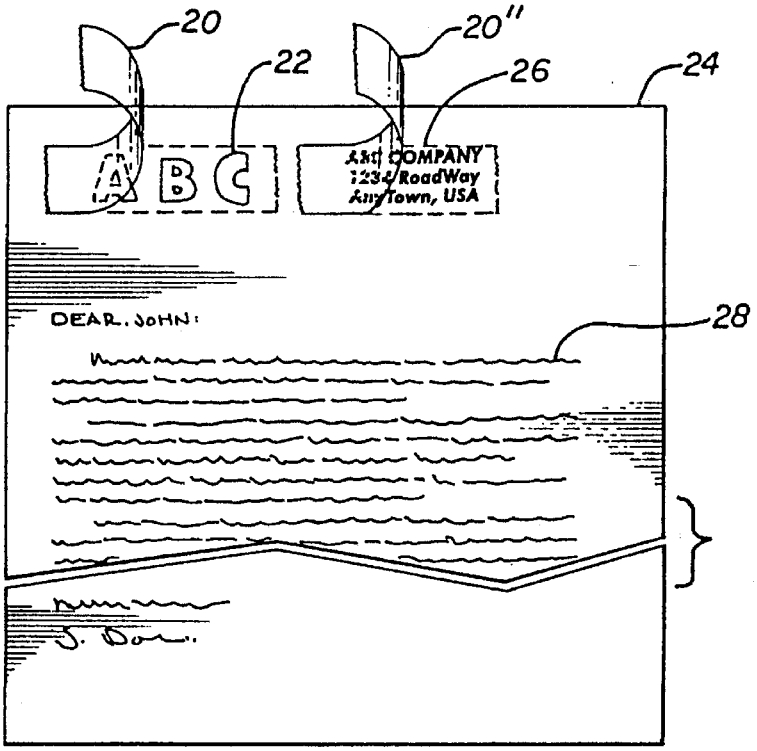
FIG. 3 is a perspective view illustrating the present invention being applied to portions of a substrate.
Figure 3A:
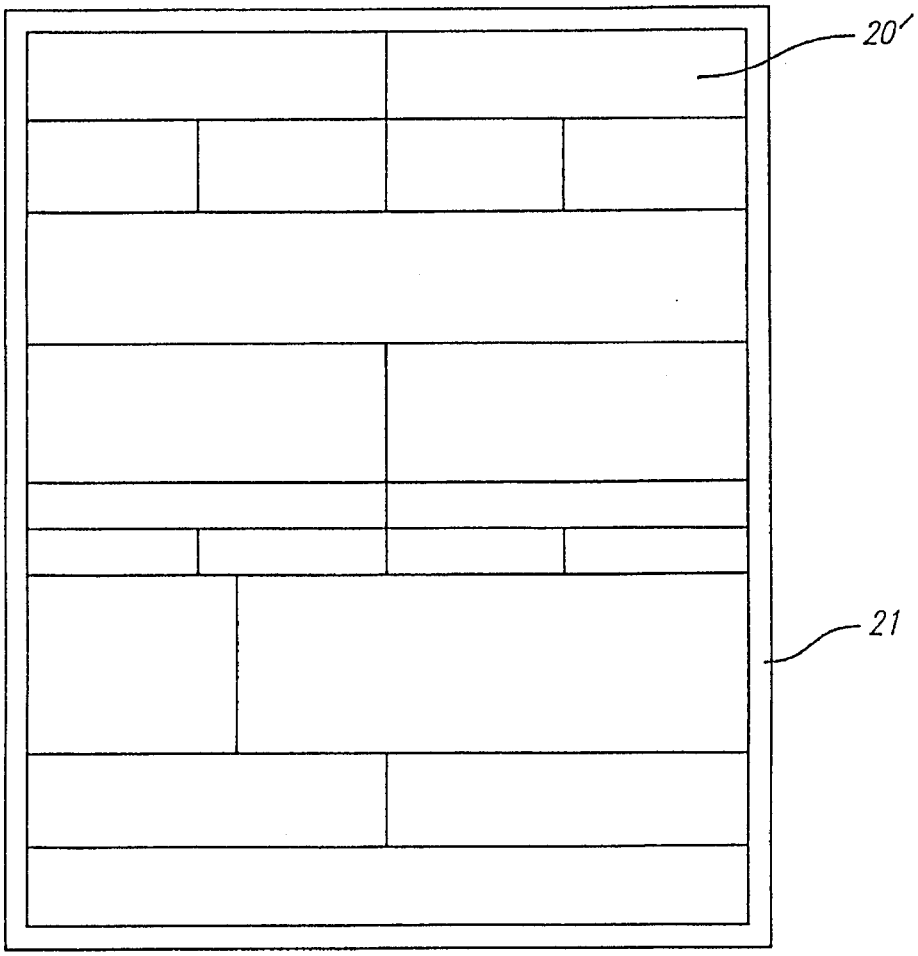
FIG. 3A is a plan view illustrating a plurality of applicators in accordance with the present invention stored on a liner sheet.

As illustrated for example in FIG. 3, an applicator 20 in accordance with the present invention may be applied to a particular toner image 22 formed on a substrate 24. As such, color will applied to the toner image 22, while other toner images (26 and 28) will remain black. As shown in FIG. 3A, a plurality of applicators 20' of predetermined lengths and widths may be secured to a liner sheet 21 coated with a release layer for storage purposes. The applicators may then be peeled from the liner prior to use and affixed to a substrate having a toner image formed thereon.

Figure 1:
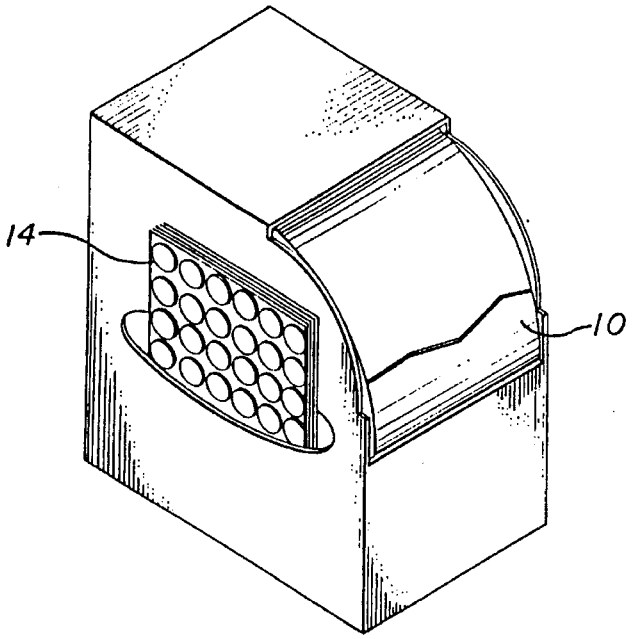
FIG. 1 PRIOR ART
FIG. 1 is a perspective view of a prior art applicator used to apply color to a toner image, a strip dispenser and a plurality of adhesive dots for securing the applicator to a substrate.
Figure 2:
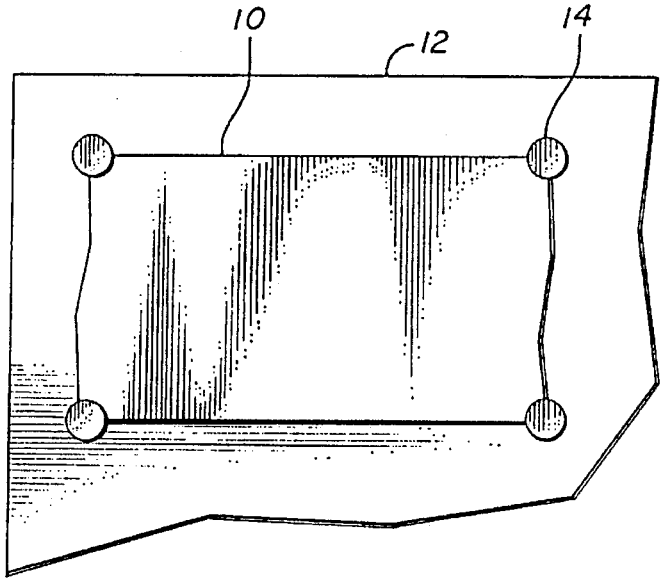
FIG. 2 PRIOR ART
FIG. 2 is a plan view of the prior art applicator illustrated in FIG. 1 secured to a substrate with the adhesive dots.
Figure 4:
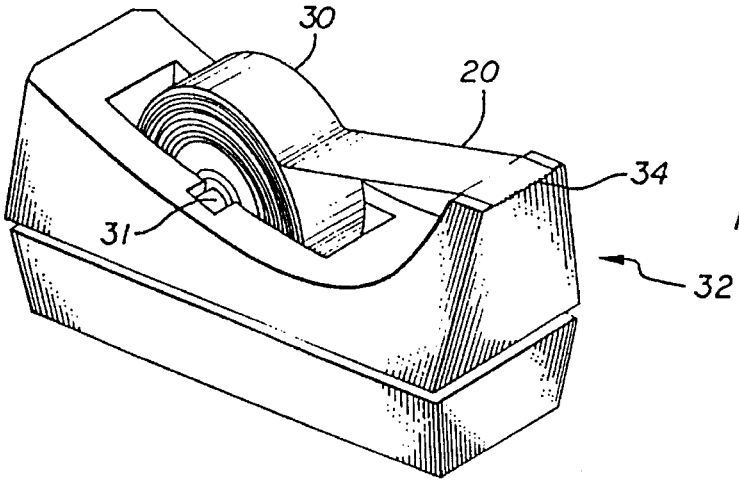
FIG. 4 is a perspective view of the present invention in roll form and shown in conjunction with a dispenser.

Referring for example to FIG. 4, the applicator 20 may be in the form of a strip of sufficient length that it can be stored in the form of a roll 30. The roll 30 may be rotatably mounted on a roller 31 in a dispenser 32 having a cutting edge 34. As such, users can tear off strips of different lengths as needed.

The applicator 20 includes a backing which may be composed of a polyester film such as Mylar™, or other suitable materials known to those of skill in the art. For example, the backing may also be composed of paper, aluminum foil and plastic sheet materials such as polypropylene. The thickness of the backing may range from approximately 0.1 mils to approximately 2.0 mils. If the backing is composed of polyester, then its thickness should preferably be between approximately 0.3 and 0.7 mils. Thicker polyester may not transfer sufficient heat during manufacture of the applicator, while thinner polyester may render the finished applicator difficult for a user to handle.

Figure 5:
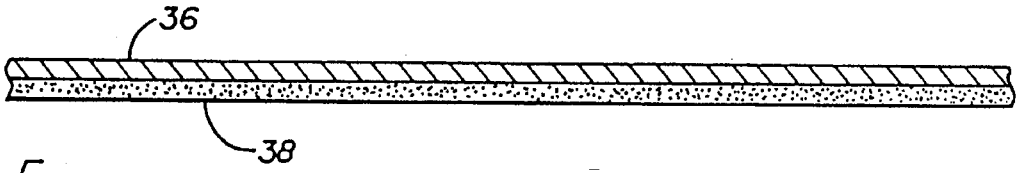
FIG. 5 is a side elevation view in accordance with a preferred embodiment of the present invention.

In accordance with the preferred embodiment illustrated in FIG. 5, a layer of color coating 38 may be formed on a backing 36. The backing may be either opaque, transparent or both colored and substantially translucent. The color coating 38 has sufficient tack to allow the applicator to be removably secured to a substrate at room temperature. However, when heat and pressure are applied to the applicator and substrate (by, for example, a fuser in a laser printer or photocopier), the color coating 38 will anchor (or bond) to the toner on the substrate, but not to the substrate itself. Thus, when the applicator is removed, the color coating will only remain on the toner image.

The compositions of preferred examples of color coatings in accordance with this embodiment of the present invention are set forth below.

| Preferred Color Coating 1 (Blue) | |
|---|---|
| R900 White Pigment<br>Kronos Inc.<br>P.O. Box 60087<br>300 N. Sam Houston Parkway<br>Houston, Texas 77205 | 25.0 parts |
| 3750 BN5 Blue Pigment<br>Sun Chemical<br>41 Sun Avenue<br>Cincinnati, Ohio 45232 | 5.0 parts |
| TS-100 Fumed Silica<br>DeGussa Corp.<br>65 Challenger Rd.<br>Ridgefield Park, New Jersey 07660 | 2.0 parts |
| K-1 Rubber Based Adhesive 28%<br>(28% solids in Toluene)<br>Avery Division<br>4350 Avery Drive<br>Flowery Branch, GA 30542 | 70.0 parts |
| Toluene<br>Ashland Chemical Co.<br>6428 Joliet Rd.<br>Countryside, IL, 60525 | 30.0 parts |
| Total Formula = 132 parts. | |

| Preferred Color Coating 2 (Blue) | |
|---|---|
| R900 White Pigment<br>Kronos Inc. (above) | 41.0 parts |
| 3750 BNS Blue Pigment<br>Sun Chemical (above) | 9.0 parts |
| K-31 Hot Melt Adhesive 39%<br>(39% solids in 50/50 MEK/Toluene)<br>Avery Division (above) | 60.0 parts |
| Methyl Ethyl Ketone (MEK)<br>Ashland Chemical Co. (above) | 15.0 parts |
| Toluene<br>Ashland Chemical Co. (above) | 15.0 parts |
| Total Formula = 140 parts. | |

| Preferred Color Coating 3 (Blue) | |
|---|---|
| R900 White Pigment<br>Kronos Inc. (above) | 41.0 parts |
| 3750 BNS Blue Pigment<br>Sun Chemical (above) | 9.0 parts |
| B-735 Acrylic 30%<br>Zeneca<br>730 Main Street | 5.0 parts |

-continued

| | |
|---|---|
| Wilmington, MA 07887-0677 | |
| K-31 Hot Melt Adhesive 39% (39% solids in Toluene) Avery Division (above) | 60.0 parts |
| MEK Ashland Chemical Co. (above) | 15.0 parts |
| Toluene Ashland Chemical Co. (above) | 15.0 parts |
| Total Formula = 145 parts. | |

Figure 7:
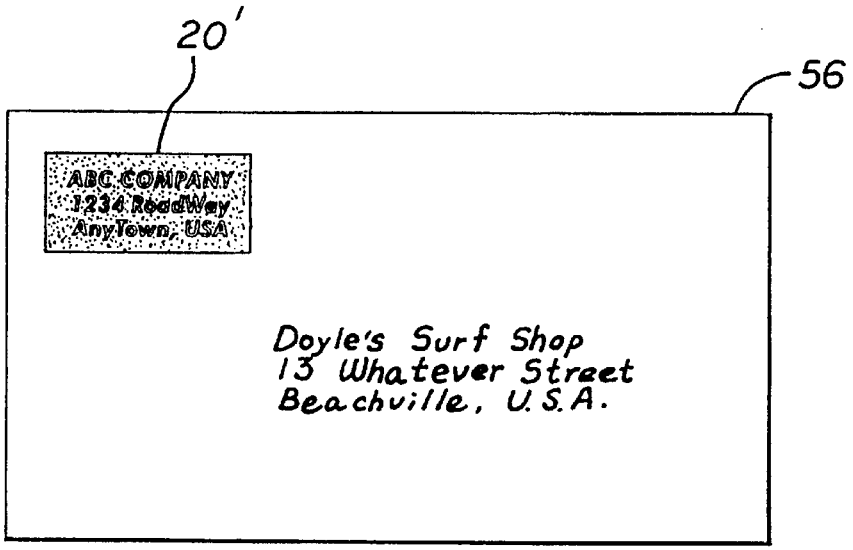
FIG. 7 is an illustration of an envelope with a previously used applicator secured thereto in accordance with certain preferred embodiments of the present invention.

Advantageously, these exemplary color coatings will remain tacky after use, thereby allowing the applicator to be affixed to another substrate after a transfer process. As shown by way of example in FIGS. 3 and 7, an applicator 20" may be placed on an envelope 56 after color has been applied to the toner image 26 (a return address). As a portion of the color coating has been removed from the applicator 20" in a pattern corresponding to the address, the color of the envelope 56 will show through this pattern. If, for example, the envelope 56 is white, the backing member is transparent and the color coating is blue, then the applicator 20" will appear to be a blue label having white characters printed thereon. If, however, the backing member is formed from a substantially translucent red material, then the applicator 20" will appear to be a violet label having red characters printed thereon.

If one desires to have an applicator which can be permanently affixed to a second substrate after a transfer process, then the following adhesive may be used in place of the K-1 Rubber Based Adhesive in Color Coating 1 and the K-31 Hot Melt Adhesive in Color Coatings 2 and 3:

Styrene-Isoprene Rubber Solution Pressure Sensitive Adhesive, such as Morstik 125 Morton International 100 N. Riverside Plaza Chicago, Ill. 60606-1598

Such coatings will remain slightly tacky for a short period, preferably about ten minutes, and become permanent thereafter, preferably in about an hour. Also, as noted above, the applicator should be stored on a liner having a release layer (not shown), or another similar storage medium, when such color coatings are used.

Figure 6:
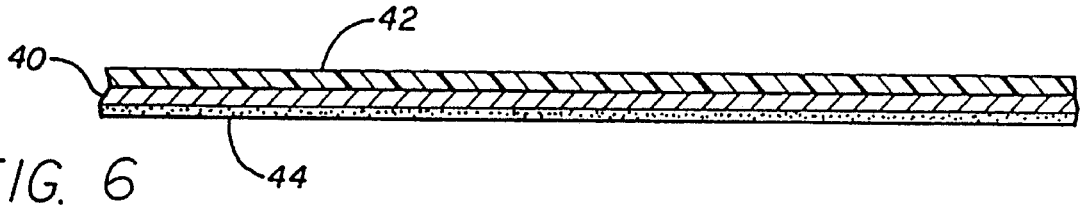
FIG. 6 is a side elevation view in accordance with another preferred embodiment of the present invention.

In accordance with the preferred embodiment illustrated in FIG. 6, a color coating layer 40 is formed on a backing member 42, which may be either opaque, transparent or both colored and substantially translucent. An adhesive layer 44 is formed on the color coating layer 40. The adhesive layer 44 may be advantageously composed of a pressure sensitive adhesive that will removably secure the applicator to a substrate at room temperature. However, the adhesive will anchor (or bond) to the toner image, but not to the substrate, when heat and pressure are applied. Thus, when the backing member is removed, the adhesive (as well as the color coating associated with the adhesive) will remain on the toner image. The thickness of the adhesive layer 44 may range from approximately 0.1 mils to approximately 1.0 mil. Preferably, the thickness of the adhesive layer 44 is approximately 0.2 mils.

The compositions of preferred examples of adhesives in accordance with this embodiment of the present invention are set forth below.

| Preferred Adhesive Layer 1 | |
|---|---|
| Gelva 1151 Monsanto 800 N. Lindbergh Blvd. St. Louis, MO 63167 | 98.0 parts |

-continued

| | |
|---|---|
| TS-100 Fumed Silica DeGussa Corp. (above) | 2.0 parts |

| Preferred Adhesive Layer 2 | |
|---|---|
| AS-341 Avery Division (above) | 98.0 parts |
| TS-100 Fumed Silica DeGussa Corp. (above) | 2.0 parts |

These exemplary adhesives will remain tacky after use, thereby allowing the applicator to be affixed to another substrate after a transfer process. If one desires to have an applicator which can be permanently affixed to a second substrate after a transfer process, then the following adhesive may be used in place of the Gelva 1151 and the AS-341 adhesives in Preferred Adhesive Layers 1 and 2, respectively:

Styrene-Isoprene Rubber Solution Pressure Sensitive Adhesive, such as Morstik 125 Morton International (above)

Such coatings will remain slightly tacky for a short period, preferably about ten minutes, and become permanent thereafter, preferably in about one hour. The applicator should be stored on a liner having a release layer, or another similar storage medium, when such adhesives are used.

In accordance with another preferred embodiment (not illustrated), a pressure sensitive adhesive layer and a color coating layer may be arranged side-by-side (or with a small space therebetween) on a backing member. The color layer may be positioned on the desired toner image by positioning the adhesive layer adjacent to the image. The pressure sensitive adhesive is adapted to removably adhere to a substrate or to toner upon application thereto at room temperature. However, the adhesive will not bond to the substrate or to toner upon the application of heat and pressure. The color coating will bond to the toner image, but not to the substrate, upon the application of heat and pressure.

Accordingly, a user may easily position the applicator on a substrate so that the color coating layer covers a desired toner image. The adhesive layer will secure the applicator to the substrate. After the heat and pressure have been applied, the applicator may be removed by simply peeling it off of the substrate. Only the color coating that was in contact with toner will remain, thereby forming a color layer on the desired toner image.

The compositions of preferred examples of color coatings and adhesives in accordance with this embodiment of the present invention are set forth below.

| Preferred Color Coating 4 (Blue) | |
|---|---|
| B-735 Acrylic 30% (30% solids in 50/50 MEK/Toluene) Zeneca (above) | 9.5 parts |
| DP39700 White Dispersion Gibralter Chemical Works 114 E. 168th Street South Holland, Illinois 60473 | 59.0 parts |
| DP34100 Blue Dispersion Gibralter Chemical Works (above) | 11.4 parts |
| TS-100 Fumed Silica DeGussa Corp. (above) | 1.0 part |
| MEK Ashland Chemical Co. (above) | 9.6 parts |
| Toluene Ashland Chemical Co. (above) | 9.6 parts |
| Total Formula = 100. | |

-continued

| Preferred Color Coating 5 (Red) | |
|---|---|
| DP39700 White Dispersion<br>Gibralter Chemical Works (above) | 38.5 parts |
| DP58580 Yellow Dispersion<br>Gibralter Chemical Works (above) | 4.3 parts |
| DP60163 Orange Dispersion<br>Gibralter Chemical Works (above) | 35.0 parts |
| TS-100 Fumed Silica<br>DeGussa Corp. (above) | 1.0 parts |
| MEK<br>Ashland Chemical Co. (above) | 10.6 parts |
| Toluene<br>Ashland Chemical Co. (above) | 10.6 parts |
| Total Formula = 100.0. | |

| Preferred Color Coating 6 (Green) | |
|---|---|
| DP39700 White Dispersion<br>Gibralter Chemical Works (above) | 30.1 parts |
| B-735 Acrylic 30%<br>(30% solids in 50/50 MEK/Toluene)<br>Zeneca (above) | 8.6 parts |
| DP58580 Yellow Dispersion<br>Gibralter Chemical Works (above) | 4.4 parts |
| 46035150 Green Dispersion<br>Gibralter Chemical Works (above) | 30.1 parts |
| TS-100 Fumed Silica<br>DeGussa Corp. (above) | 1.0 part |
| MEK<br>Ashland Chemical Co. (above) | 12.9 parts |
| Toluene<br>Ashland Chemical Co. (above) | 12.9 parts |
| Total Formula = 100.0. | |

Preferred Adhesive

Emulsion Acrylic Pressure Sensitive Adhesive, such as Morstik 240 (or Morstik 242) Morton International (above)

Figure 8:
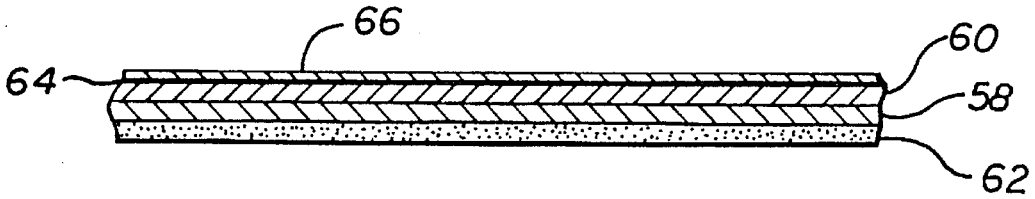
FIG. 8 is a side elevation view in accordance with still another preferred embodiment of the present invention.

Referring now to the preferred embodiment shown in FIG. 8, an opaque permanent color layer 58 may be formed on a backing 60. A color coating layer 62 is formed on permanent color layer 58. The permanent color layer and color coating should be different colors and, preferably, colors which sharply contrast with one another. A permanent adhesive layer 64 and a liner 66 are applied to the opposite side of the backing 60. The composition of a preferred example of the opaque permanent color layer is set forth below.

| Preferred Opaque Color Coating 1 (Yellow) | |
|---|---|
| PE-20 Polyester Resin<br>Shell Chemical<br>State Route 2<br>Apple Grove, WV 25502 | 20.0 parts |
| Hydral 710 Aluminas<br>Whittaker, Clark & Daniels, Inc.<br>1000 Coolidge Street<br>South Plainfield, NJ 07080 | 14.0 parts |
| LR-7248 Yellow Dispersion<br>Lancer Dispersions, Inc.<br>1680 East Market Street<br>Akron, OH 44305 | 4.0 parts |
| MEK<br>Ashland Chemical (above) | 33.0 parts |
| Toluene<br>Ashland Chemical (above) | 29.0 parts |
| Total Formula = 100.0. | |

The color coating 62 has sufficient tack to allow the applicator to be removably secured to a substrate at room temperature. Preferred Color Coatings 1–3 (above) are generally suitable here. However, the following adhesive may be used in place of the K-1 Rubber Based Adhesive in Color Coating 1 and the K-31 Hot Melt Adhesive in Color Coatings 2 and 3 in order to insure that the tackiness of the color coating layer will dissipate after use.

| Dissipating Adhesive 1 | |
|---|---|
| Gelva 1151<br>Monsanto (above) | 45.23 parts |
| ETAC Solvent<br>Chem Central<br>750 W. 71st Street<br>Chicago, IL 60638 | 54.72 parts |
| PAPI-27 Polymeric Isocyanate<br>Dow Chemical<br>2040 Bldg.<br>Midland, MI 48674 | 00.05 parts |
| Total = 100.0. | |

When heat and pressure are applied to the applicator and substrate, the color coating 62 will anchor (or bond) to the toner on the substrate, but not to the substrate itself. When the applicator is removed, the color coating 62 will only remain on the toner image. The portion of color coating corresponding to the toner image will be removed from the permanent color layer 58, thereby allowing the permanent color layer to show through. As such, the applicator now looks like a printed label. The liner 66 may be removed thereafter so that the applicator can be permanently affixed to another substrate in label-like fashion.

Figure 9:
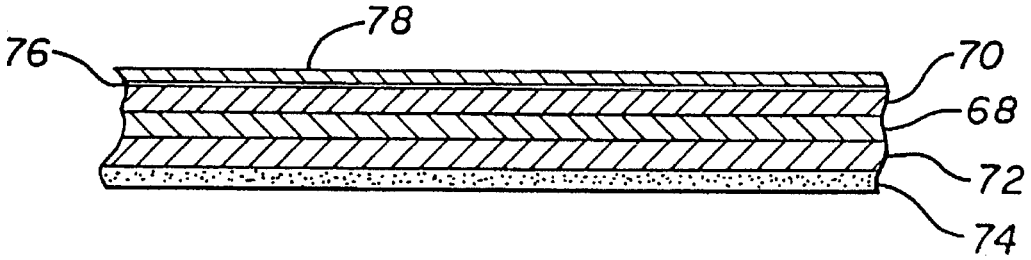
FIG. 9 is a side elevation view in accordance with still another preferred embodiment of the present invention.

Turning to the exemplary embodiment shown in FIG. 9, a permanent color layer 68 is formed on a backing member 70. A color coating layer 72 is formed on the permanent color layer 68 and an adhesive layer 74 is formed on the color coating layer. The adhesive layer 74 may be advantageously composed of a pressure and heat sensitive adhesive that will removably secure the applicator to a substrate at room temperature. Preferred Adhesive Layers 1 and 2 (discussed above) are generally suitable here. However, they may be replaced with the "Dissipating Adhesive 1" (described above) in order to insure that the tackiness of the layer will dissipate after use. As noted above, the thickness of the adhesive layer may range from approximately 0.1 mils to approximately 1.0 mil, and is preferably approximately 0.2 mils. The adhesive will anchor (or bond) to the toner image, but not to the substrate, when heat and pressure are applied.

When the applicator is removed, the adhesive (as well as the associated color coating) will remain on the toner image and the permanent color layer 68 will show through the portion of the color coating layer 72 corresponding to the toner image. Again, the applicator now looks like a printed label. The cover sheet 78 may be removed thereafter so that the applicator can be permanently affixed to another substrate.

Figure 10:
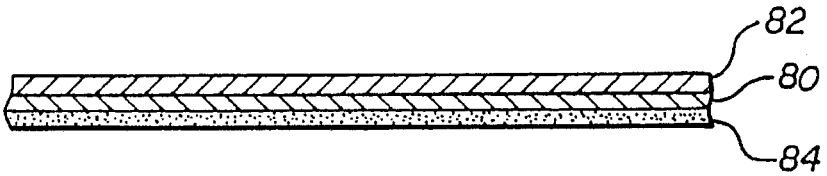
FIG. 10 is a side elevation view in accordance with a further preferred embodiment of the present invention.

As illustrated for example in FIG. 10, another preferred embodiment includes a substantially translucent permanent color layer 80 formed on a backing 82. A color coating layer 84 is formed on permanent color layer 80. The permanent color layer and color coating should be different colors and, when mixed, combine to form a color which contrasts with permanent color layer. The composition of a preferred example of the substantially translucent permanent color layer is set forth below.

| Preferred Translucent Color Coating 1 (Yellow) | |
|---|---|
| LR-5047 Yellow Dispersion<br>Lancer Dispersions, Inc. (above) | 16.0 parts |

-continued

| Preferred Translucent Color Coating 1 (Yellow) | |
|---|---|
| PE-200 Polyester Resin<br>Goodyear Chemicals (above) | 28.0 parts |
| MEK<br>Ashland Chemical (above) | 33.0 parts |
| Toluene<br>Ashland Chemical (above) | 33.0 parts |
| Total Formula = 110.0. | |

Preferred Color Coatings 1–3 may be used here. As noted above, such color coatings will remain tacky after the color transfer process, thereby enabling the applicator to be adhered to another substrate. Should it be desired that the applicator be permanently affixed to a second substrate, then the adhesive aspects of Color Coatings 1–3 may be modified in the manner described above and the applicator should be stored on a liner having a release layer.

After a color transfer process and removal of the applicator from the substrate, the color coating 84 will only remain on the toner image. The portion of the color coating corresponding to the toner image will be removed from the permanent color layer 80. The applicator may then be used as a two color label having the toner image in the color of the permanent layer and a background in the color that results from the combination of the coating and permanent layer colors.

Figure 11:
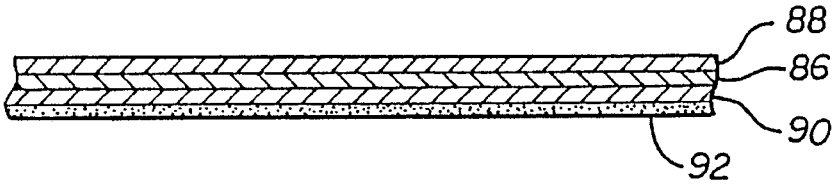
FIG. 11 is a side elevation view in accordance with a still further preferred embodiment of the present invention.

The embodiment illustrated in FIG. 11 is similar to that illustrated in FIG. 10, except that the adhesive and color coating are formed in separate layers. In particular, a substantially translucent permanent color layer 86 is formed on a backing 88, a color coating layer 90 is formed on the permanent color layer and an adhesive layer 92 is formed on the color coating layer. The adhesive layer should be composed of material which is the same as, or substantially similar to, adhesive layer 74 (discussed above with reference to FIG. 9). When the applicator is removed after a color transfer process, the adhesive and associated color coating will remain on the toner image. As indicated in the preceding paragraph, the applicator may then be used as a two color label having the toner image in the color of the permanent layer and a background in the color that results from the combination of the coating and permanent layer colors.

Figure 12:
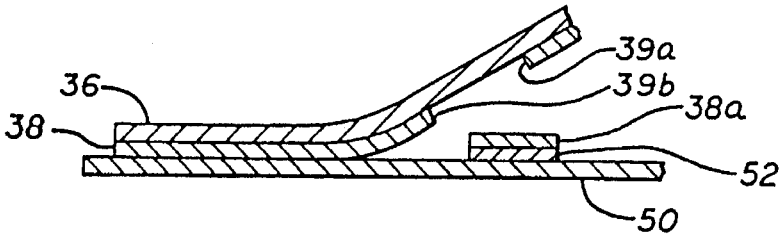
FIG. 12 is a side elevation view in accordance with the preferred embodiment illustrated in FIG. 5.

In all of the preferred embodiments, it is important that the color coating is sufficiently friable to insure good edge definition. In other words, when the backing member is pulled away from the substrate, the fractures in the color coating layer must occur easily and must be clean. This concept is illustrated in FIG. 12 which shows the applicator illustrated in FIG. 5 being peeled off of a substrate 50 and a portion of a toner image 52. The portion (38*a*) of the color coating layer 38, which was in contact with the toner 52 prior to the application of heat and pressure, has bonded to the toner. Thus, when the backing member 36 is pulled away from the substrate 50, the coating layer 38 breaks and edges 39*a* and 39*b* are formed. In accordance with the present invention, these breaks are clean, i.e. the color coating portion 38*a* will fracture right at the edge of the toner 52, thereby forming the smooth sides illustrated in FIG. 12.

Unless this is the case, the quality of the color coating on the toner image will be unacceptable. For example, if the coating lacks sufficient friability, then the center portions of the letters "o", "p" and "e" will be covered by the color coating. In accordance with the present invention, adequate friability may be obtained by forming a color coating consisting of two or three layers, the combined thickness of the layers ranging from approximately 0.1 mils to approximately 1.0 mil. The preferred combined thickness of the layers is approximately 0.3 mils.

Although the present invention has been described in terms of the preferred embodiments above, numerous modifications and/or additions to the above-described preferred embodiments would be readily apparent to one skilled in the art. For example, different chemical combinations may be utilized for the color coating and/or the adhesive. Additionally, the present invention is not limited to use with toner. Rather, the present invention may be practiced in conjunction with inks and other printing materials where the image is heat conducting, for example ink with toner as the pigment in a solvent or carrier. The color coating is or may be adapted to bond therewith. It is intended that the scope of the present invention extends to all such modifications and/or additions and that the scope of the present invention is limited solely by the claims set forth below.

What is claimed is:

1. An applicator/label system, comprising:

an applicator/label including flexible transparent sheet material, a color coating formed on said sheet material which will bond to a heat conducting image, and pressure sensitive adhesive material associated with said sheet material for adhering said applicator to one or more substrates;

a first substrate having a heat conducting image printed thereon, and an outer color layer on said image received from said color coating; and a second toner-free substrate to which said applicator/label is affixed following an application of color to said image on said first substrate;

whereby the heat conducting image on said first substrate is colorized and the second substrate has a label applied thereto with a color outline of the image to which color was transferred to on said first substrate.

2. An applicator for selectively applying a color layer to a toner image formed on a substrate, the applicator comprising:

a polyester strip defining a thickness substantially between approximately 0.1 mils and approximately 2.0 mils, the polyester strip being stored in the form of a roll;

a color coating formed on the polyester strip, the color coating having a pressure and heat sensitive adhesive incorporated therein which is sufficiently tacky to removably adhere to the substrate and to toner upon application of the applicator to the substrate at room temperature, which will bond to the toner image, but not to the substrate, in response to an application of heat to form the color layer on the toner image, and which will be sufficiently tacky after the application of heat to removably adhere to a toner-free substrate, the color coating defining a thickness substantially between approximately 0.1 mils and 1.0 mil; and a dispenser for rotatably supporting the roll, the dispenser including a sharp cutting element for cutting the polyester strip.

3. An applicator for selectively applying a color layer to a toner image formed on a substrate, the applicator comprising:

a backing member;

a color coating formed on the backing member; and a pressure and heat sensitive adhesive incorporated within the color coating which is sufficiently tacky to removably adhere to the substrate and to toner upon application of the applicator to the substrate at room temperature, which will bond to the toner image, but not to the substrate, in response to an application of heat to form the color layer on the toner image, and which will be sufficiently tacky after the application of heat to removably adhere to a toner-free substrate.

4. An applicator as claimed in claim 3, wherein the backing member comprises a roll of polyester film.

5. An applicator as claimed in claim 4, wherein the backing member comprises a roll of polyethylene terephthalate film.

6. An applicator as claimed in claim 3, wherein the backing member defines a thickness substantially between approximately 0.1 mils and approximately 2.0 mils.

7. An applicator as claimed in claim 3, wherein the color coating defines a thickness substantially between approximately 0.1 mils and 1.0 mils.

8. An applicator for selectively applying a color layer to a toner image formed on a substrate, the applicator comprising:

a backing member;

a color layer permanently associated with the backing member;

a color coating formed on the color layer; and a pressure and heat sensitive adhesive associated with the backing member which is sufficiently tacky to removably adhere to the substrate and to toner upon application of the applicator to the substrate at room temperature, and which will bond to the toner image, but not to the substrate, in response to an application of heat to form the color layer on the toner image.

9. An applicator as claimed in claim 8, wherein the color layer is substantially opaque.

10. An applicator as claimed in claim 8, wherein the color layer is substantially translucent.

11. An applicator as claimed in claim 8, wherein the backing member comprises a roll of polyester film.

12. An applicator as claimed in claim 8, wherein the backing member defines a thickness substantially between approximately 0.1 mils and approximately 2.0 mils.

13. An applicator as claimed in claim 8, wherein the pressure and heat sensitive adhesive will be sufficiently tacky after the application of heat to removably adhere to a toner-tree substrate.

14. A method of selectively applying color to a toner image formed on a first substrate and transferring an image corresponding to the toner image onto a second toner-free substrate, the method comprising the steps of:

providing an applicator having a backing member, a color coating formed on the backing member, and a pressure and heat sensitive adhesive associated with the backing member which is sufficiently tacky to removably adhere to the first substrate and to toner upon application of the applicator to the first substrate at room temperature and adhere to the substrate and to the toner image as the substrate passes through one of a laser printer and a photocopier without the aid of additional mounting structure, which will remain at a removable level of tackiness for a substantial period prior to an application of heat, which will bond to the toner image, but not to the substrate, in response to an application of heat to form the color layer on the toner image, and which will be sufficiently tacky after the application of heat to removably adhere to the second substrate;

placing the applicator on the toner image on the first substrate;

applying a sufficient amount of heat to the applicator to cause the pressure and heat sensitive adhesive to bond to the toner image;

removing the applicator from the first substrate; and transferring the applicator to the second substrate.

15. A method as claimed in claim 14, wherein the second substrate is an envelope.

16. An applicator for selectively applying a color layer to a toner image formed on a substrate, the applicator comprising:

a polyester strip defining a thickness substantially between approximately 0.1 mils and approximately 2.0 mils, the polyester strip being stored in the form of a roll;

a color coating formed on the polyester strip defining a thickness substantially between approximately 0.1 mils and 1.0 mil;

a pressure and heat sensitive adhesive incorporated within the color coating which is sufficiently tacky to removably adhere to the substrate and to the toner image upon application of the applicator to the substrate at room temperature, and which will bond to the toner image, but not to the substrate, in response to an application of heat to form the color layer on the toner;

a dispenser for rotatably supporting the roll, the dispenser including a sharp cutting element for cutting the polyester strip.

17. An applicator for selectively applying a color layer to a toner image formed on a substrate, the applicator comprising:

a backing member;

a color coating formed on the backing member; and a pressure and heat sensitive adhesive associated with the backing member which is sufficiently tacky to removably adhere to the substrate and to the toner image upon application of the applicator to the substrate at room temperature and adhere to the substrate and to the toner image as the substrate passes through one of a laser printer and a photocopier without the aid of additional mounting structure, which will remain at a removable level of tackiness for a substantial period prior to an application of heat, and which will bond to the toner image, but not to the substrate, in response to an application of heat to form the color layer on the toner image.

18. An applicator for selectively applying a color layer to a toner image formed on a substrate, the applicator comprising;

a backing member;

a color coating formed on the backing member; and a pressure and heat sensitive adhesive incorporated within the color coating which is sufficiently tacky to removably adhere to the substrate and to the toner image upon application of the applicator to the substrate at room temperature, and which will bond to the toner image, but not to the substrate, in response to an application of heat to form the color layer on the toner image.

19. An applicator as claimed in claim 18, wherein the backing member comprises a roll of polyester film.

20. An applicator as claimed in claim 19, wherein the backing member comprises a roll of polyethylene terephthalate film.

21. An applicator as claimed in claim 18, wherein the backing member defines a thickness substantially between approximately 0.1 mils and approximately 2.0 mils.

22. An applicator as claimed in claim 18, wherein the color coating defines a thickness substantially equal to approximately 0.3 mils.

23. An applicator for selectively applying a color layer to a toner image formed on a substrate, the applicator comprising:

a backing member;

a color coating formed on the backing member: and a pressure and heat sensitive adhesive associated with the backing member which is sufficiently tacky to removably adhere to the substrate and to toner upon application of the applicator to the substrate at room temperature and adhere to the substrate and to the toner image as the substrate passes through one of as aser printer and a photocopier without the aid of additional mounting structure, which will remain at a removable level of tackiness for a substantial period prior to an application of heat, which will bond to the toner image, but not to the substrate, in response to an application of heat to form the color layer on the toner image, and which will be sufficiently tacky after the application of heat to removably adhere to the toner-free substrate and remain sufficiently tacky to removably adhere to the toner-free substrate for a substantial predetermined period after the application of heat and will then bond to the toner-free substrate at the end of the substantial predetermined period.

24. An applicator as claimed in claim 23, wherein the substantial predetermined period equals approximately ten minutes.

25. An applicator as claimed in claim 13, wherein the adhesive will remain sufficiently tacky to removably adhere to the toner-free substrate for a substantial predetermined period after the application of heat and will then bond to the toner-free substrate at the end of the substantial predetermined period.

26. An applicator as claimed in claim 25, wherein the substantial predetermined period equals approximately ten minutes.

27. A color applicator assembly comprising:

a liner sheet having a release surface; and a plurality of applicators for selectively applying a color layer to a toner image formed on a substrate removably affixed to the liner sheet, each applicator including a backing member, a color coating formed on the backing member, and a pressure and heat sensitive adhesive associated with the backing member which is sufficiently tacky to removably adhere to the substrate and to toner upon application of the applicator to the substrate at room temperature and adhere to the substrate and to the toner image as the substrate passes through one of a laser printer end a photocopier without the aid of additional mounting structure, which will remain at a removable level of tackiness for a substantial period prior to an application of heat, which will bond to the toner image, but not to the substrate, in response to an application of heat to form the color layer on the toner image, and which will be sufficiently tacky after the application of heat to removably adhere to a toner-free substrate and remain sufficiently tacky to removably adhere to the toner-free substrate for a substantial predetermined period after the application of heat end will then bond to the toner-free substrate at the end of the substantial predetermined period.

28. An applicator as claimed in claim 27, wherein the substantial predetermined period equals approximately ten minutes.

29. An applicator as claimed in claim 14, wherein the adhesive will remain sufficiently tacky to removably adhere to the second substrate for a substantial predetermined period after the application of heat and will then bond to the second substrate at the end of the substantial predetermined period.

30. An applicator as claimed in claim 29, wherein the substantial predetermined period equals approximately ten minutes.

31. An applicator as claimed in claim 2, wherein the adhesive comprises an adhesive that will melt at a temperature that will melt the toner image.

32. An applicator as claimed in claim 3, wherein the adhesive comprises an adhesive that will melt at a temperature that will melt the toner image.

33. An applicator as claimed in claim 16, wherein the adhesive comprises an adhesive that will melt at a temperature that will melt the toner image.

34. An applicator as claimed in claim 18, wherein the adhesive comprises an adhesive that will melt at a temperature that will melt the toner image.

* * * * *